US009242817B2

(12) United States Patent
Suganuma

(10) Patent No.: US 9,242,817 B2
(45) Date of Patent: Jan. 26, 2016

(54) SHEET CONVEYER AND IMAGE READING APPARATUS

(71) Applicant: Brother Kogyo Kabushiki Kaisha, Nagoya-shi, Aichi-ken (JP)

(72) Inventor: Tsuyoshi Suganuma, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/582,598

(22) Filed: Dec. 24, 2014

(65) Prior Publication Data

US 2015/0183601 A1 Jul. 2, 2015

(30) Foreign Application Priority Data

Dec. 27, 2013 (JP) ..... 2013-271982

(51) Int. Cl.

| | |
|---|---|
| ***B65H 3/06*** | (2006.01) |
| ***B65H 5/36*** | (2006.01) |
| ***B65H 1/04*** | (2006.01) |
| ***B65H 3/66*** | (2006.01) |

(52) U.S. Cl.

CPC ..... *B65H 3/0684* (2013.01); *B65H 1/04* (2013.01); *B65H 3/66* (2013.01); *B65H 5/36* (2013.01); *B65H 2404/50* (2013.01); *B65H 2404/60* (2013.01)

(58) Field of Classification Search

CPC ..... B65H 1/04; B65H 3/06; B65H 3/0615; B65H 3/0653; B65H 3/0684; B65H 3/66; B65H 5/36; B65H 2404/50; B65H 2404/60; B65H 2404/61; B65H 2404/65; B65H 2404/1531

See application file for complete search history.

(56) References Cited

U.S. PATENT DOCUMENTS

| | | | | |
|---|---|---|---|---|
| 4,901,117 | A * | 2/1990 | Derrick | B65H 3/44 271/118 |
| 6,307,621 | B1 * | 10/2001 | Endo | B65H 3/0615 346/134 |
| 7,980,549 | B2 | 7/2011 | Hamaguchi | |
| 2007/0063420 | A1 * | 3/2007 | Seike | B65H 3/06 271/109 |
| 2008/0012201 | A1 * | 1/2008 | Nakashima | B65H 3/0684 271/12 |
| 2008/0309008 | A1 | 12/2008 | Hamaguchi | |
| 2012/0133095 | A1 * | 5/2012 | Tu | B65H 3/0684 271/256 |
| 2014/0079460 | A1 * | 3/2014 | Kanaya | B65H 7/125 400/583 |
| 2014/0138904 | A1 * | 5/2014 | Arimura | B65H 3/68 271/121 |

FOREIGN PATENT DOCUMENTS

| | | |
|---|---|---|
| JP | 2008-308257 | 12/2008 |

* cited by examiner

*Primary Examiner* — Prasad Gokhale
(74) *Attorney, Agent, or Firm* — Banner & Witcoff, Ltd.

(57) ABSTRACT

A sheet conveyer comprises a sheet support surface; a first roller to convey sheets; a second roller to separate one by one the sheets to convey a sheet downstream; a holder configured to be swingably supported about a swing center axis, wherein the first roller is attached to the holder to be rotatable; and a guide formed of a separate member and comprising a guide surface extending upstream with respect to an upstream end portion of the holder and the guide guides the sheet to a portion below the holder and the first roller.

12 Claims, 11 Drawing Sheets

SHEET CONVEYER AND IMAGE READING APPARATUS

CROSS-REFERENCE TO RELATED APPLICATION

This application claims priority under 35 U.S.C. §119 from Japanese Patent Application No. 2013-271982, filed on Dec. 27, 2013. The entire subject matter of the application is incorporated herein by reference.

BACKGROUND

1. Technical Field

The following disclosure relates to a sheet conveyer and an image reading apparatus.

2. Related Art

Conventionally, a sheet conveyer comprising a first roller which conveys sheets placed on a sheet support tray to a downstream in a conveying direction and a second roller which separates the sheets conveyed by the first roller one by one and conveys the sheet to the downstream in the conveying direction has been proposed.

For example, in the sheet conveyer, a feed roller corresponding to the first roller is rotatably supported by a holder. The holder is swingably supported about an axis line coinciding with a support shaft being a rotation center of a separation roller corresponding to the second roller. The feed roller swings together with the holder, and thereby an interval between the feed roller and the sheet support tray is changed.

SUMMARY

In the above described configuration, when a user sets sheets on the sheet support tray, the sheets contact a contact part of the holder, and is guided to a lower side of the holder. At this time, the uppermost position of the sheets moves upward depending on the thickness of the sheet or the number of sheets, and the holder swings such that the upstream end of the holder moves away from the sheet support tray accordingly. As a result, the feed roller moves to a state of contacting the uppermost position of the sheets.

However, the holder configured as described above moves such that the upstream end of the holder moves further from the sheet support tray as the number of sheets set on the sheet support tray increases (or the thickness of the sheet increases even when the number of sheets is the same). Therefore, in order to achieve a configuration in which the holder is allowed to be sufficiently displaced, a large space needs to be secured in a portion opposite to the sheet support tray with respect to the holder. When such a large space is secured, the size of the configuration close to the holder increases accordingly. This becomes a factor preventing decrease of the size or the thickness of the sheet conveyer.

Aspects of the disclosure relate to a sheet conveyer and an image reading apparatus capable of decreasing the size of a space to be secured close to a holder which supports a first roller.

According to an aspect of the disclosure, there is provided a sheet conveyer, comprising: a sheet support surface configured to support sheets; a first roller configured to convey the sheets supported by the sheet support surface to a downstream in a conveying direction; a second roller configured to separate one by one the sheets conveyed by the first roller and to convey a sheet to the downstream in the conveying direction; a holder configured to be swingably supported about a swing center axis coinciding with a rotation center of the second roller, wherein the first roller is attached to the holder to be rotatable about an axis parallel with the swing center axis; and a guide formed of a member provided independently of the holder, the guide comprising a guide surface extending on an upstream in the conveying direction with respect to an upstream end portion of the holder in the conveying direction, the guide being configured such that when the sheet is set on the sheet support surface and the sheet contacts and slides on the guide surface, the guide guides the sheet to a portion below the holder and the first roller along the guide surface.

According to another aspect of the disclosure, there is provided an image reading apparatus, comprising: a reading unit configured to read an image on a sheet conveyed along a predetermined sheet conveying path; and the above described sheet conveyer.

BRIEF DESCRIPTION OF THE ACCOMPANYING DRAWINGS

For a more complete understanding of the present disclosure, needs satisfied thereby, and the objects, features, and advantages thereof, reference now is made to the following illustrative descriptions taken in connection with the accompanying drawings.

FIGS. 2A and 2B illustrate an internal structure of an image reading apparatus according to the embodiment, in which FIG. 2A is a vertical cross section illustrating a state where a first cover is closed and FIG. 2B is a vertical cross section illustrating a state where the first cover is opened.

FIGS. 6A and 6B are partial cross sections cut along a line VI-VI indicated in FIG. 5B, in which FIG. 6A is a partial cross section illustrating a state where a feed roller is disposed at a lowermost position and FIG. 6B is a partial cross section illustrating a state where the feed roller is disposed at an uppermost position.

Figure 5A:
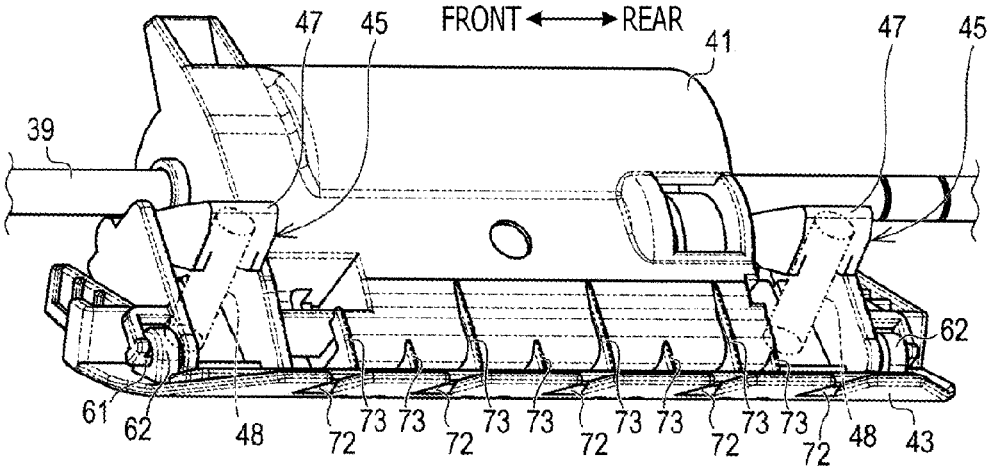
FIG. 5A is a perspective view illustrating a holder, a guide part and a pressing part.
Figure 5B:
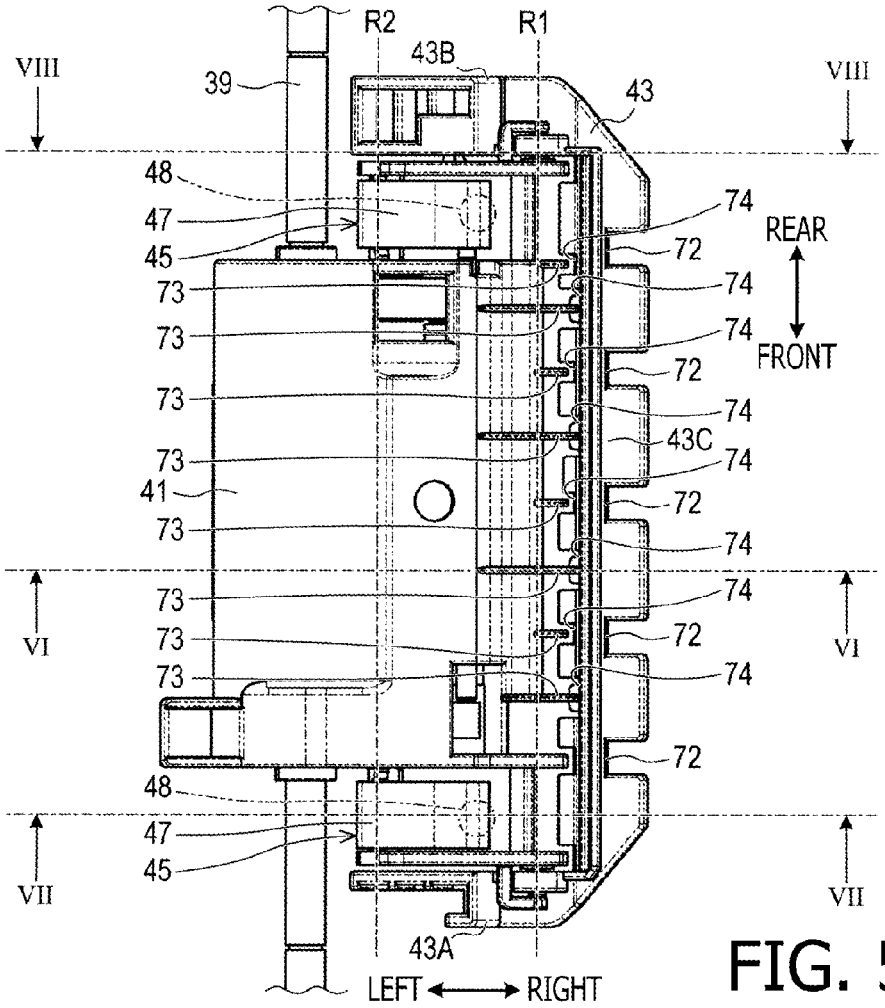
FIG. 5B is a plan view illustrating the holder, the guide part and the pressing part.
Figure 7A:
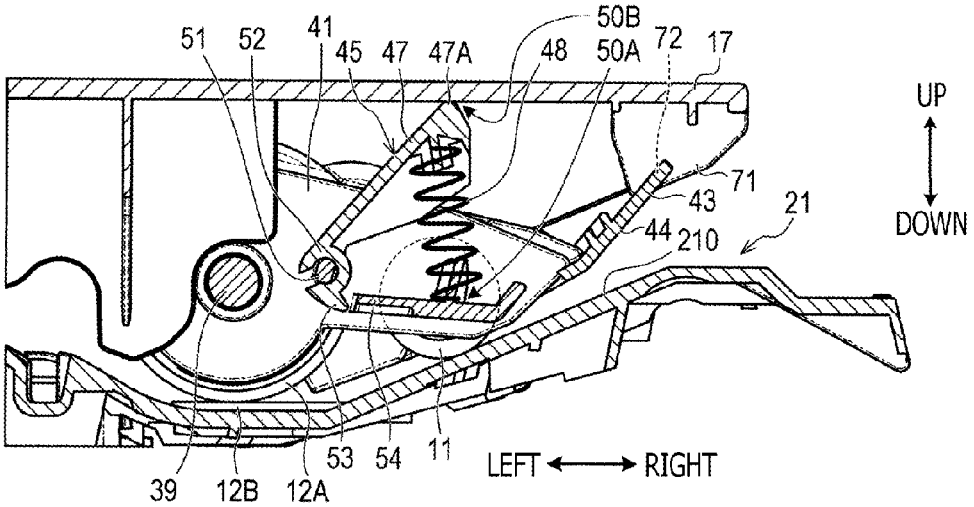
Figure 7B:
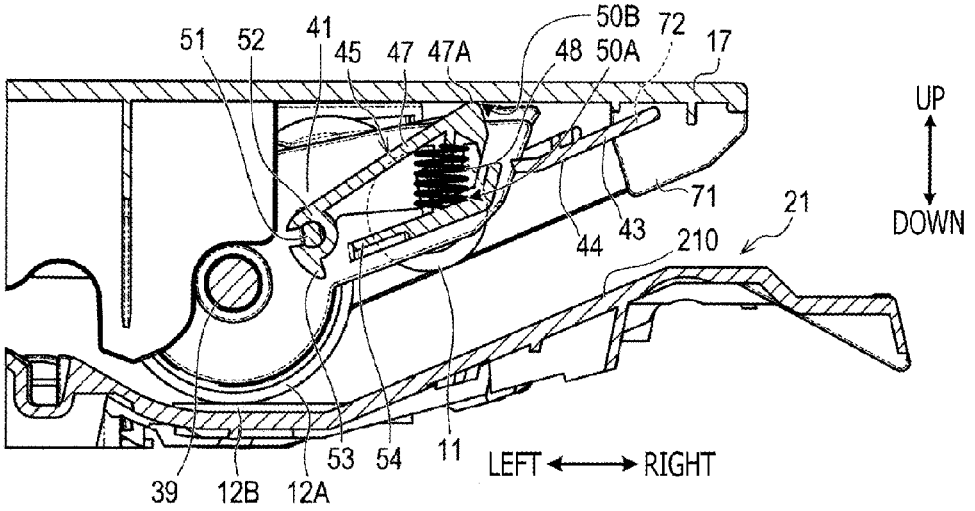
Figure 7C:
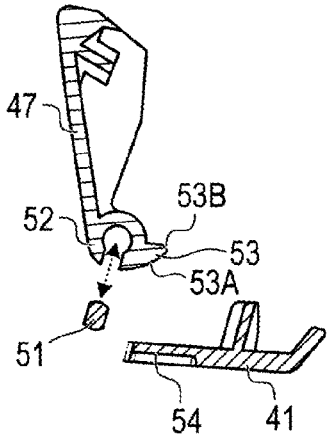
Figure 7D:
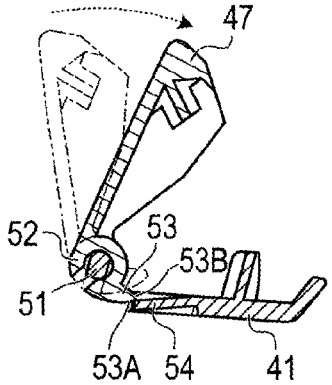
Figure 7E:
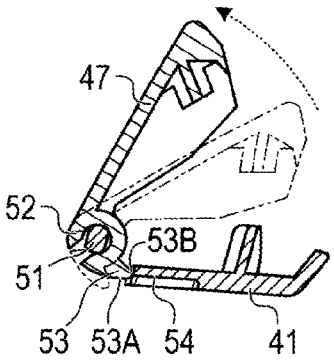

FIG. 7A is a partial cross section cut along a line VII-VII indicated in FIG. 5B illustrating a state where the feed roller is disposed at the lowermost position, FIG. 7B is a partial cross section cut along the line VII-VII indicated in FIG. 5B illustrating a state where the feed roller is disposed at the uppermost position, and FIGS. 7C to 7E are explanatory illustrations for explaining a movable range of a contacting member.

Figure 8A:
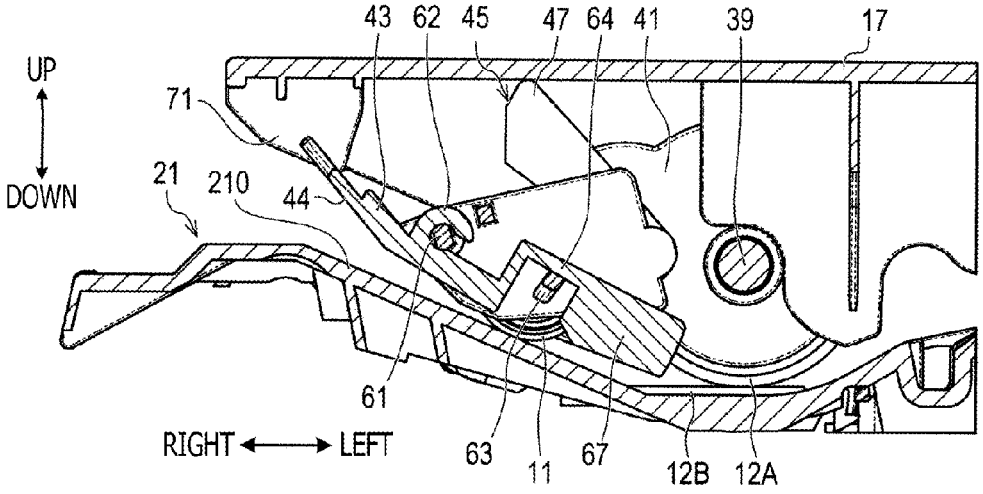

FIG. 8A is a partial cross section cut along a line VIII-VIII indicated in FIG. 5B, and FIGS. 8B to 8D are explanatory illustrations for explaining a movable range of the guide part.

Figure 9A:
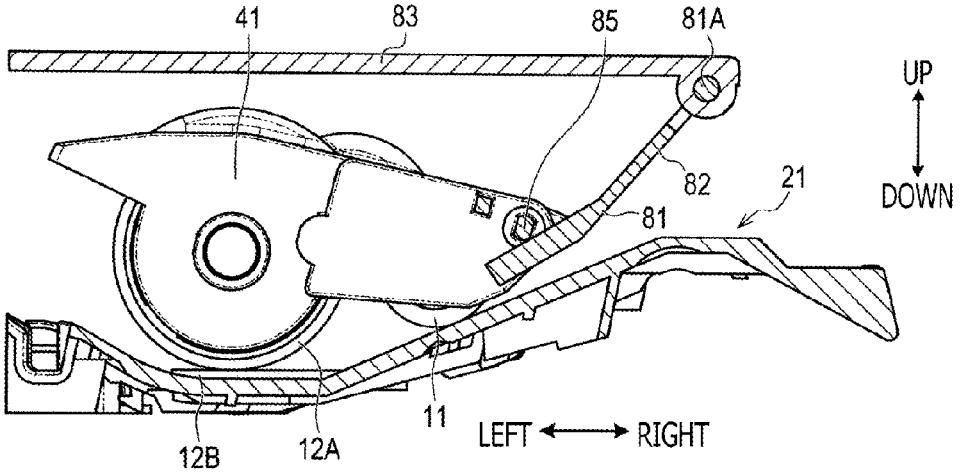
Figure 9B:
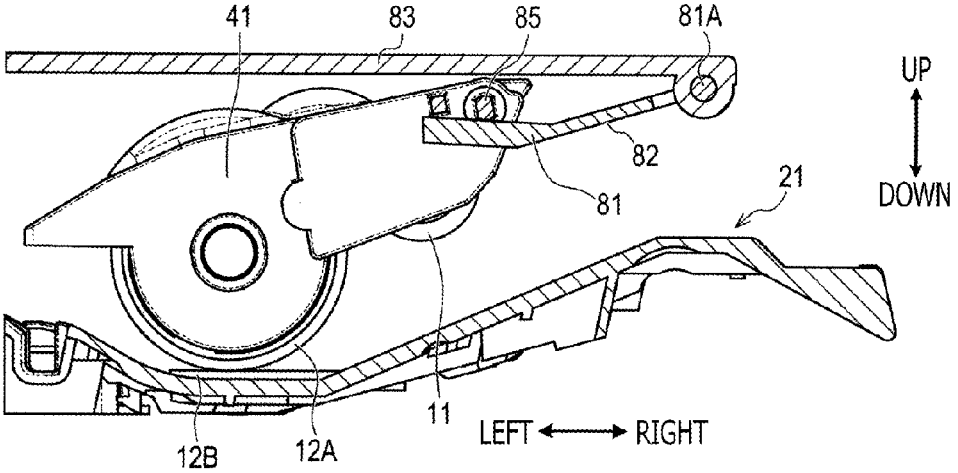

FIGS. 9A and 9B illustrate another embodiment concerning a swing center of the guide part, in which FIG. 9A is a partial cross section illustrating a state where the feed roller is at the lowermost position, and FIG. 9B is a partial cross section illustrating a state where the feed roller is at the uppermost position.

DETAILED DESCRIPTION

Hereafter, a sheet conveyer and an image reading apparatus according to an embodiment will be described with reference to the accompanying drawings.

Configuration of Multifunction Peripheral

Figure 1:
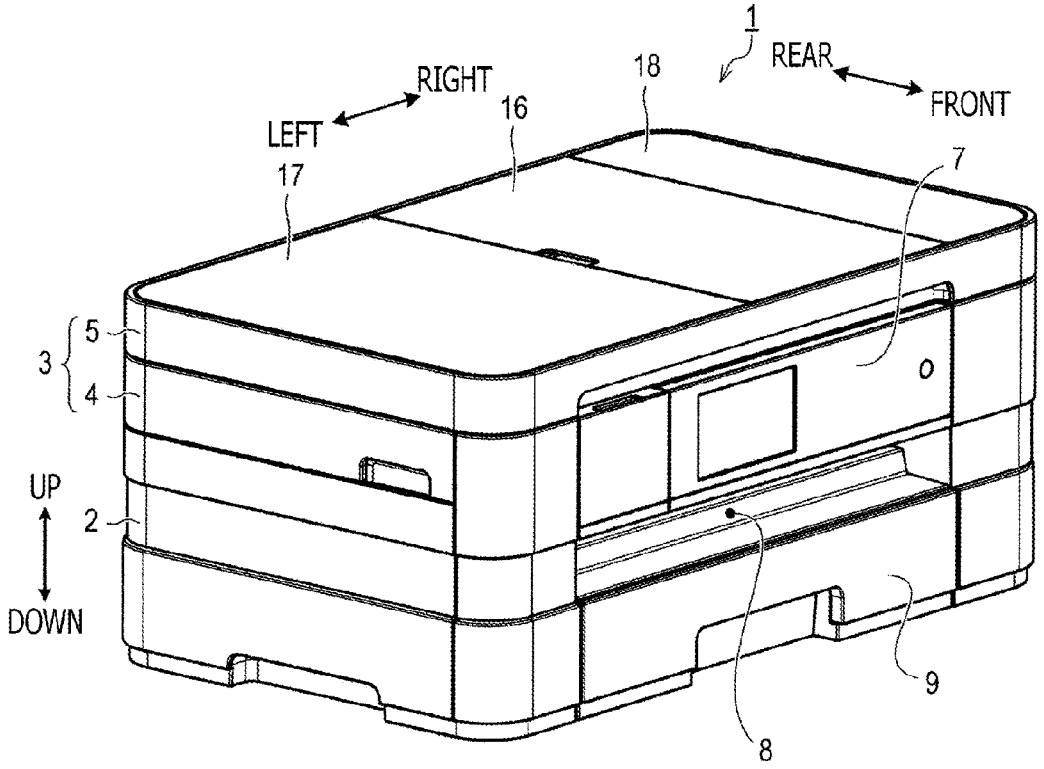
FIG. 1 is a perspective view of a multifunction peripheral according to an embodiment.

A multifunction peripheral 1 shown in FIG. 1 is provided with the sheet conveyer and the imaging reading apparatus according to the embodiment. In the following explanation, in order to explain a relative positional relationship between components constituting the multifunction peripheral 1, up, down, left and right directions written in the drawings are used.

The multifunction peripheral 1 includes a main body unit 2 and a reading unit 3 mounted on the upper side of the main body unit 2. The reading unit 3 is attached to the main body unit 2 to be openable and closable with respect to the main body unit 2. In a state where the reading unit 3 is closed, an opening formed on the upper surface of the main body unit 2 is covered with the reading unit 3.

The reading unit 3 includes a flat bed (hereafter, abbreviated as "FB") unit 4, and an ADF unit 5 provided on the upper side of the FB unit 4. The ADF unit 5 is attached to the FB unit 4 to be openable and closable with respect to the FB unit 4. In the state where the ADF unit 5 is closed, the ADF unit 5 serves as a cover covering the upper surface of the FB unit 4.

In the main body unit 2, various units including a control unit, an image forming unit, a LAN communication unit and a PSTN communication unit are provided. At the upper front part of the main body unit 2, an operation panel 7 to be operated by a user is provided. Below the operation panel 7, an output port 8 through which a recording medium on which an image has been formed in the image forming unit is picked up is formed. Below the output port 8, a media supply cassette 9 in which recording media to be supplied to the image forming unit is stored is attached.

Figure 2A:
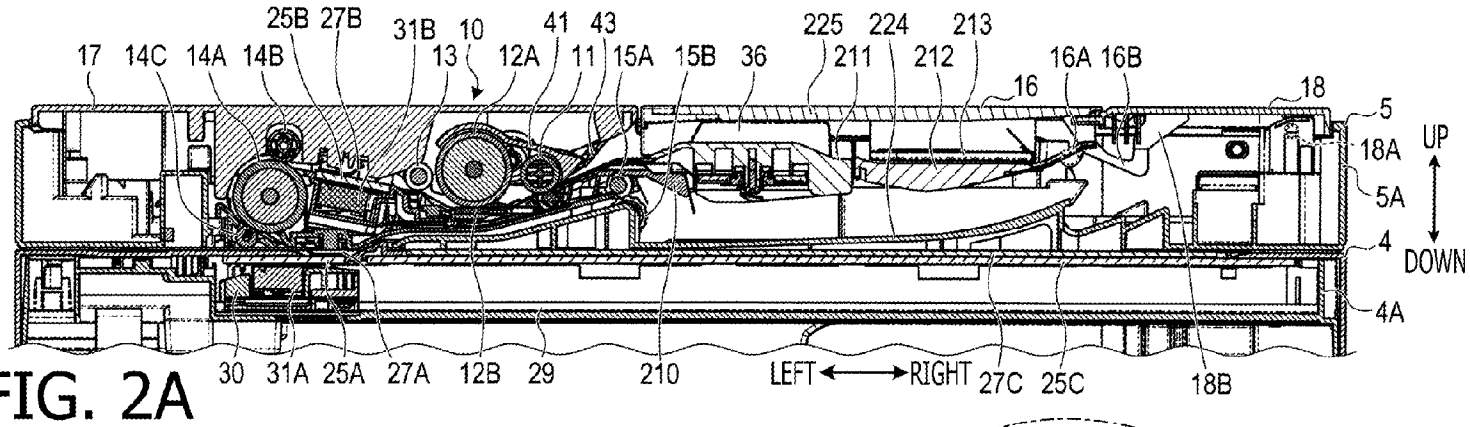
Figure 2B:
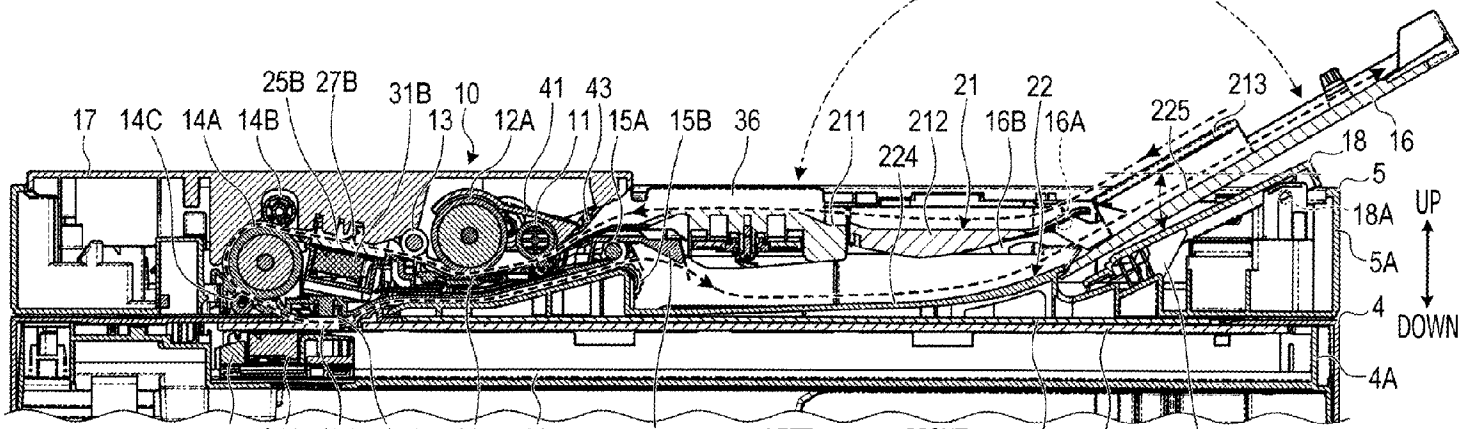

As shown in FIGS. 2A and 2B, on the upper surface of the ADF unit 5, a first cover 16, a second cover 17 and a third cover 18 are provided. The first cover 16, the second cover 17 and the third cover 18 constitute an outer covering of the ADF unit 5 together with a ADF base 5A forming a bottom part and a side wall part of the ADF unit 5.

The first cover 16 is rotatable between a stored position shown in FIG. 2A and a use position shown in FIG. 2B with respect to a rotation shaft 16A positioned close to the right end of the first cover 16 disposed at the stored position. The third cover 18 is rotatable between a horizontal position shown in FIG. 2A and an inclined position shown in FIG. 2B, with respect to a rotation shaft 18A positioned close to the right end of the third cover 18.

In the state where the first cover 16 and the third cover 18 are at the positions shown in FIG. 2A, a boss (not shown) provided at a tip of an arm 16B formed to extend from the first cover 16 enters an arm receiver 18B formed on a lower surface of the third cover 18, and the boss supports the third cover 18 from the lower side. That is, since the arm 16B extending from the first cover 16 supports the third cover 18 from the lower surface, the first cover 16 and the third cover 18 form a horizontal surface. The term "horizontal" as used herein means a case where the first cover 16 and the third cover 18 form a completely horizontal surface as well as a case where the first cover 16 and the third cover 18 form a surface having a small degree of unevenness or inclined parts. When the first cover 16 is rotated from the stored position to the use position in this state, the boss of the arm 16B moves downward and lets the left end part of the third cover 18 moves downward. As a result, the third cover 18 rotates from the horizontal position shown in FIG. 2A to the inclined position shown in FIG. 2B in conjunction with rotation of the first cover 16.

When the first cover 16 rotates from the stored position to the use position, the third cover 18 reaches the inclined position before the first cover 16 reaches the use position. However, the boss of the arm 16B thereafter moves away from the arm receiver 18B and reaches the use position without letting the third cover 18 move. Furthermore, when the first cover 16 rotates from the use position to the stored position, the first cover 16 rotates initially without letting the third cover 18 move, but the boss of the arm 16B enters the arm receiver 18B before the first cover 16 reaches the stored position. Therefore, the boss of the arm 16B thereafter lifts up the left end part of the third cover 18 until the first cover 16 reaches the stored position. As a result, the third cover 18 rotates in conjunction with rotation of the first cover 16, and the third cover 18 reaches the horizontal position at substantially the same time that the first cover 16 reaches the stored position.

In the state where the first cover 16 has moved to the use position, in the ADF unit 5, a first support unit 21 and a second support unit 22 are formed. The first support unit 21 supports, from the below, the document before being supplied to the conveying unit 10, and the second support unit 22 supports, from the below, the document after being discharged from the conveying unit 10. At least a part of the first support unit 21 and at least a part of the second support unit 22 are positioned to overlap with each other in the up and down direction to have an interval therebetween. In this case, the first support unit 21 is disposed on the upper side of the second support unit 22, and the second support unit 22 is disposed on a lower side of the first support unit 21.

As shown in FIGS. 2A and 2B, the first support unit 21 includes a chute member 210 which guides the document in a downwardly slanting direction in the conveying unit 10, a first tray 211 which supports the document at a position nearest to the chute member 210 disposed on the conveying unit 10, a second tray 212 which supports the document at a position further from the conveying unit 10 than the first tray 211, and a third tray 213 which supports the document at a position further from the conveying unit 10 than the second tray 212. The chute member 210, the first tray 211, the second tray 212 and the third tray 213 constitute a sheet support surface which supports documents. The second support unit 22 includes a fourth tray 224 which supports the document at a position nearest to the conveying unit 10 and a fifth tray 225 which supports the document at a position further from the conveying unit 10 than the fourth tray 224. The fifth tray 225 is formed of one side of the first cover 16, and the third tray 213 is attached to the one side of the first cover 16 to have an interval between the third tray 213 and the fifth tray 225. Therefore, in the state where the first cover 16 is moved to the use position, the third tray 213 and the fifth tray 215 are disposed at positions for constituting the first support unit 21 and the second support unit 22, respectively. In the state where the first cover 16 is moved to the stored position, the first cover 16 covers the upper side of the first tray 211 and the second tray 212, and the third tray 213 and the fifth tray 225 moved together with the first cover 16 are stored in the inside of the ADF unit 5 in the state where the third tray 213 and the fifth tray 225 are oriented downward.

The document placed on the first support unit 21 is conveyed along the conveying path indicated by the thick dashed line shown in FIG. 2B, and is discharged to the second support unit 22. At this time, the documents conveyed to the downstream in the conveying direction from the first support unit 21 by the feed roller 11 are separated by the separation roller 12A and the separation pieces 12B one by one. Then, the document is conveyed further by the intermediary roller 13 and the conveying roller 14A to the downstream in the conveying direction, and is discharged to the upper surface of the second support unit 22 by the discharge roller 15A.

A first transparent member 25A and a first document presser 27A are provided between the conveying roller 14A and the discharge roller 15A on the conveying path. Further, A second transparent member 25B and a second document presser 27B are provided between the intermediary roller 13 and the conveying roller 14A on the conveying path.

The first transparent member 25A is disposed on the FB unit 4, and the second transparent member 25B, the first document presser 27A and the second document presser 27B are disposed on the ADF unit 5. In this embodiment, each of the first transparent member 25A and the second transparent member 25B is formed of a glass plate, and is configured to extend, in a range exceeding the width of the document, in the width direction which is orthogonal to the conveying direction of the document.

Each of the first document presser 27A and the second document presser 27B is made of metal or rigid resin, and is formed to extend in a range exceeding the width of the document as in the case of the first transparent member 25A and the second transparent member 25B.

The first document presser 27A is pressed toward the first transparent member 25A by a spring (not shown), and prevents the document passing the first transparent member 25A while contacting the upper surface of the first transparent member 25A from rising from the first transparent member 25A. The second document presser 27B is pressed toward the second transparent member 25B by a spring (not shown), and prevents the document passing the second transparent member 25B while contacting the upper surface of the second transparent member 25B from rising from the second transparent member 25B.

A third transparent member 25C is provided in the FB unit 4, and a third document presser 27C is provided in the ADF unit 5. In this embodiment, the third transparent member 25C is made of a glass plate as in the case of the first transparent member 25A and the second transparent member 25B. However, the third transparent member 25C has a sufficiently wide area to the extent that the entire document targeted for image reading is included.

The third document presser 27C is formed of a laminated body in which a foamed resin layer and a rigid resin layer are laminated. When the ADF unit 5 is closed, the third document presser 27C closely contacts the third transparent member 25C with a small degree of elastic deformation, and prevents the document placed on the third transparent member 25C from rising from the third transparent member 25C.

The FB unit 4 includes a guide rail 29, a carriage 30 and a first image sensor 31A. The ADF unit 5 includes a second image sensor 31B. The guide rail 29 is integrally provided with the inner surface of the bottom part of a housing 4A of the FB unit 4. More specifically, the guide rail 29 is configured to extend in the left and right direction, in a range extending from a position under the first transparent member 25A to a position under the third transparent member 25C in the state where the guide rail 29 is in parallel with the lower surfaces of the first transparent member 25A and the third transparent member 25C.

The carriage 30 is attached to the upper side of the guide rail 29. As a result, the carriage 30 is supported in the state where the carriage 30 is able to reciprocate in the left and right direction along the guide rail 29. The carriage 30 is coupled to a timing belt (not shown), and reciprocates in accordance with circular driving of the timing belt.

In this embodiment, each of the first image sensor 31A and the second image sensor 31B uses a contact type image sensor (CIS; Contact Image Sensor). The first image sensor 31A is mounted on the carriage 30, and moves to reciprocate in the left and right direction together with the carriage 30.

A spring (not shown) is provided to intervene between the first image sensor 31A and the carriage 30, and the first image sensor 31A is pressed toward the upper side. Further, a spacer (not shown) is attached near the both ends in the front and rear direction of the first image sensor 31A. The spacer is pressed upward together with the first image sensor 31A. The space is able to contact the lower surface of the third transparent member 25C or the first transparent member 25A.

With this configuration, when the first image sensor 31A reciprocates with the carriage 30, the spacer maintains the state where the spacer contacts the lower surface of the third transparent member 25C or the first transparent member 25A. The first image sensor 31A moves while maintaining a constant distance with respect to the third transparent member 25C or the first transparent member 25A.

The second image sensor 31B is disposed at a predetermined position, and does not move from the predetermined position. However, the second image sensor 31B is also pressed toward the second transparent member 25B by a spring (not shown). As a result, the second image sensor 31B is disposed to maintain a constant distance with respect to the second transparent member 25B.

A plurality of reading elements provided in each of the first image senor 31A and the second image sensor 31B are aligned in the front and rear direction defined in this embodiment. When an image of a document placed on the third transparent member 25C is read, the first image sensor 31A moves along with the carriage 30 to read the image of the document.

When an image of a document being conveyed by the conveying unit 10 is read, the first image sensor 31A stops at a position under the first document presser 27A and the first transparent member 25A, and reads the image of the document passing therethrough while contacting the upper surface of the first transparent member 25A. The second image sensor 31B is disposed under the second document presser 27B and the second transparent member 25B, and reads the image of the document passing therethrough while contacting the upper surface of the second transparent member 25B.

Figure 3:
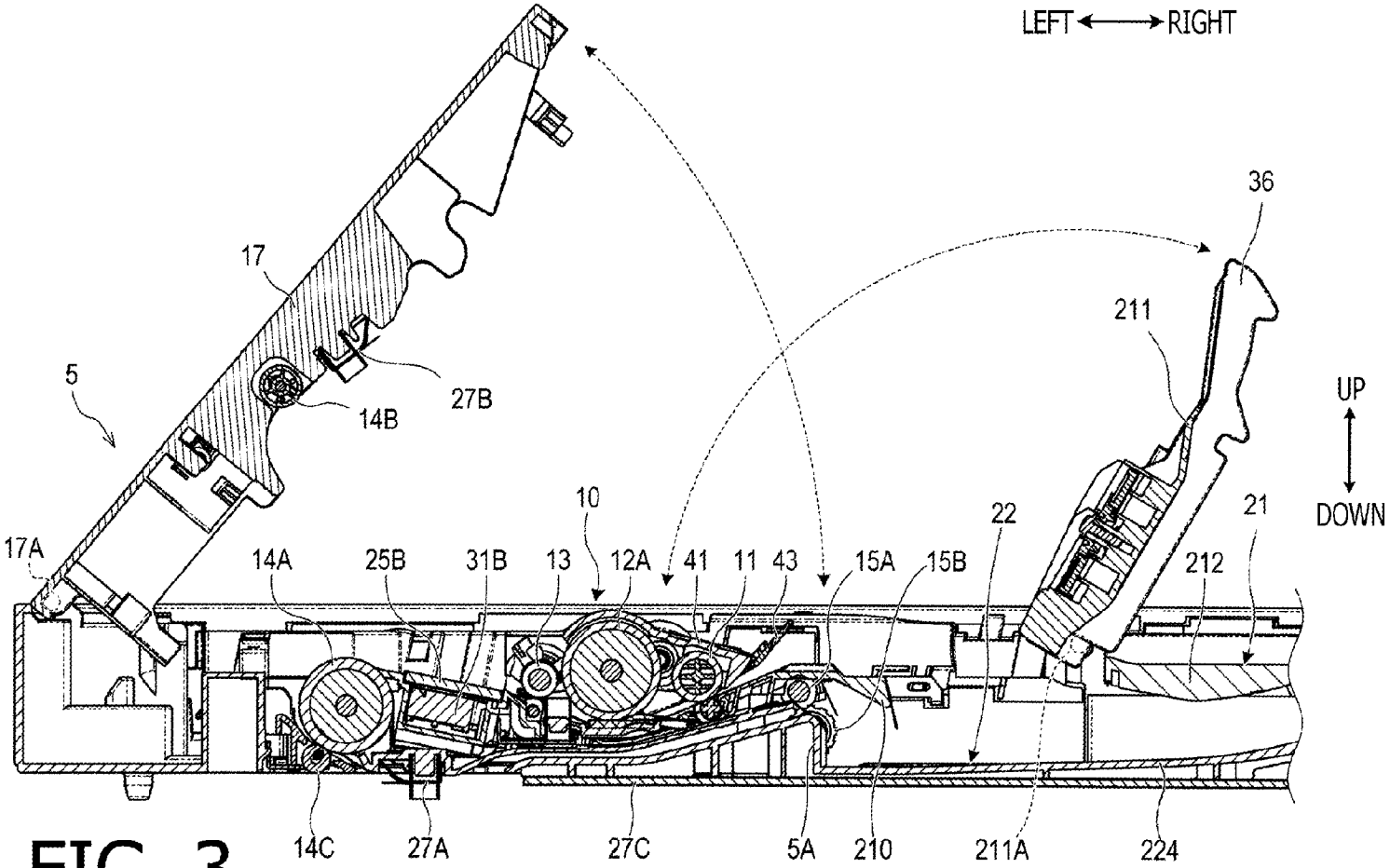
FIG. 3 is a partial cross section illustrating a state where a second cover and a first tray are opened.

As shown in FIG. 3, the first tray 211 is provided to be rotatable about a rotation shaft 211A, and is movable between a closed position shown in FIG. 2B and an opened position shown in FIG. 3. The first tray 211 supports the document at the closed position. On the other hand, when the first tray 211 has moved to the opened position, a part of the fourth tray 224 disposed under the first tray 211 is exposed. As shown in FIG. 3, the second cover 17 is rotatable about a rotation shaft 17A, and moves between a closed position shown in FIG. 2B and an opened position shown in FIG. 3.

Figure 4:
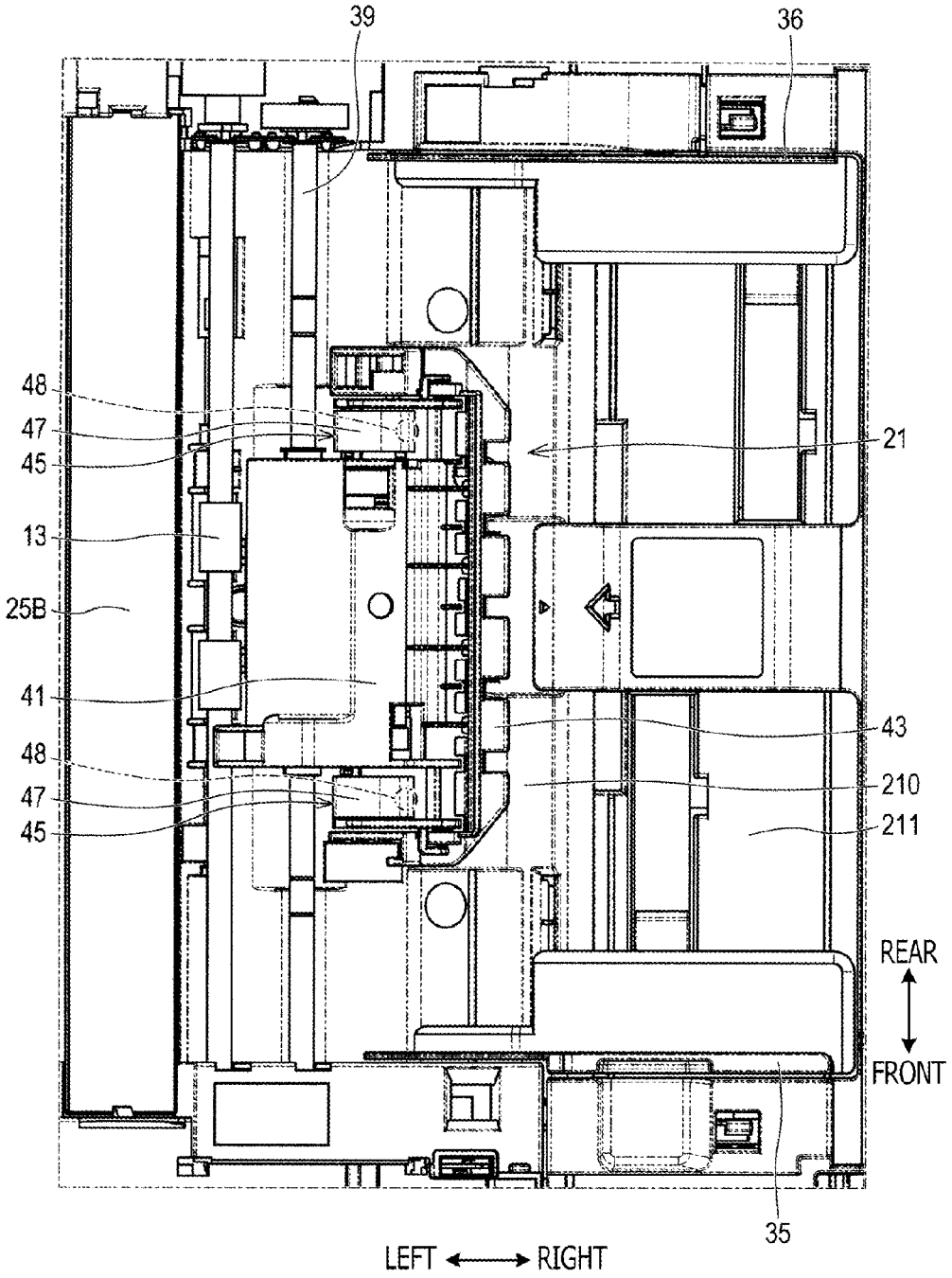
FIG. 4 is a plan view illustrating a configuration of a holder and a peripheral part thereof.

As shown in FIG. 4, side guides 35 and 36 are attached to the first tray 211. The side guides 35 and 36 are disposed to have an interval therebetween in a width direction (the front and rear direction in FIG. 4) which is perpendicular the conveying direction of the document. Each of the side guides 35 and 36 is slidable in the front and rear direction relative to the first tray 211. The side guides 35 and 36 are configured such that when one of the side guides 35 and 36 slides, the other of the side guides 35 and 36 also slides in conjunction with movement of the one of the side guides 35 and 36. When a document is placed on the first support unit 21, the side guides 35 and 36 contact edges in the width direction of the document, and restricts the conveying direction of the document to a predetermined direction.

Details about Holder and Pressing Unit

Figure 6A:
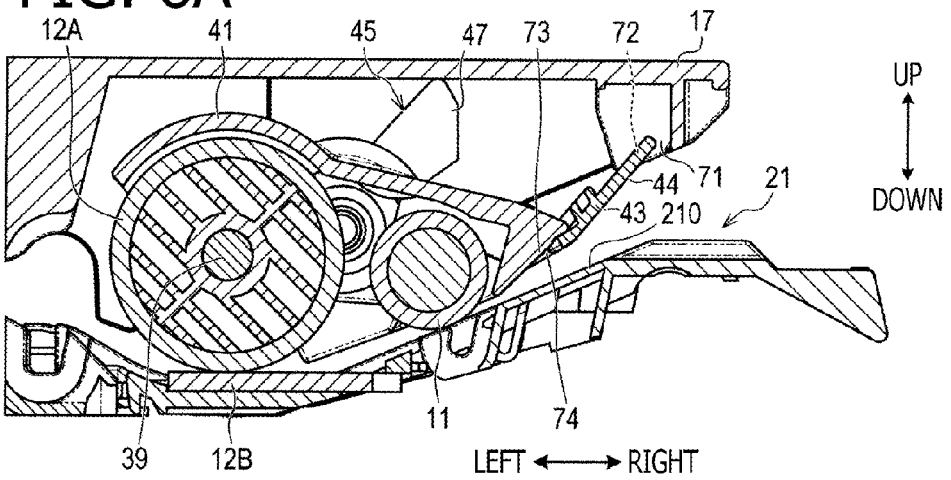
Figure 6B:
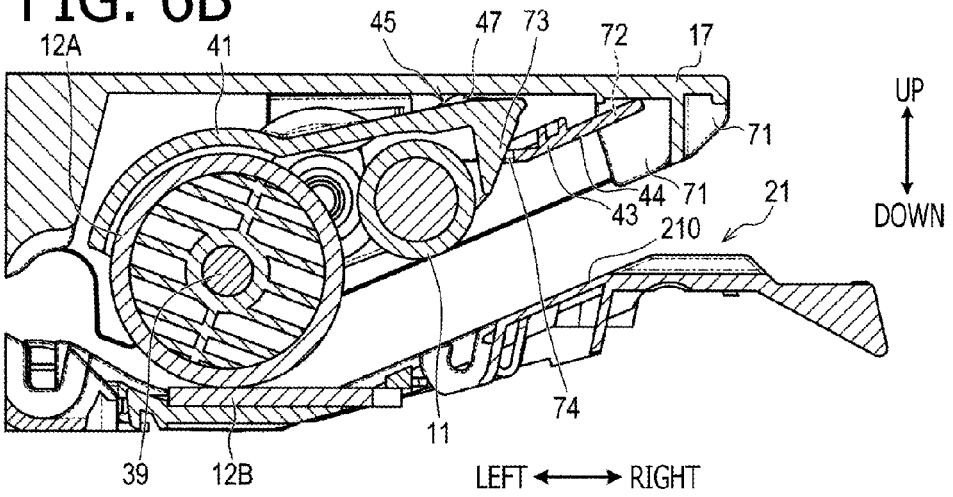

As shown in FIGS. 4, 5A and 5B, a holder 41 is attached to a rotation shaft 39 which rotatably supports the separation roller 12A. The holder 41 is supported to be swingable about an axis line which coincides with the rotation center axis of the separation roller 12A. In the state where the second cover 17 is at the closed position, the holder 41 is swingable between the lowest position shown in FIGS. 6A and 7A and the highest position shown in FIGS. 6B and 7B. The feed roller 11 is rotatably attached to the holder 16, and the feed roller 11 rotates about an axis line which is parallel with the swing center axis of the holder 41. The feed roller 11 swings together with the holder 41, and thereby the interval between the feed roller 11 and the first support unit 21 (specifically, the chute member 210) is changed.

A guide part 43 and a pair of pressing parts 45 and 45 are attached to the holder 41. The pressing parts 45 and 45 are attached, on the upper surface of the holder 41, to both ends of the holder 41 in an axis direction (the front and rear direction in this embodiment) being the swing axis line. Each of the pressing parts 45 and 45 includes a contacting member 47 and a spring member 48. The contacting members 47 and 47 are swingably attached to the holder 41, and swing about an axis line R2 shown in FIG. 5B. As shown in FIGS. 7A and 7B, the spring member 48 is a compression spring provided between the lower surface of the contacting member 47 and the upper surface of the holder 41.

The contacting member 47 is oriented such that an end of the contacting member 47 on the left side in FIG. 5B is positioned closer to the swing center axis (the drive shaft 39) than the other end of the contacting member 47 on the right side in FIG. 5B. The swing center axis of the contacting member 47 is on the above described one end side of the contacting member 47, and the spring member 48 is provided between the above described other end of the contacting member 47 and the holder 41. The pressing part 45 and the feed roller 11 are disposed not to overlap with each other in regard to the axis direction of the feed roller 11. The feed roller 11 and the spring member 48 are disposed to overlap with each other when viewed along the rotation axis direction of the feed roller 11.

In the pressing parts 45 and 45 configured as described above, the lower end of the spring member 48 presses a first portion 50A of the holder 41, and the contacting member 47 presses a second portion 50B of the second cover 17 at a corner part 47A formed to protrude upward. Therefore, each of the pressing parts 45 and 45 generates a pressing force with respect to the holder 41 to press the first portion 50A to move away from the second portion 50B, and thereby presses the feed roller 11 toward the first support unit 21.

A support shaft 51 rotatably supporting the contacting member 47 is formed integrally with the holder 41. As shown in FIGS. 7A to 7E, the support shaft 51 has a shape where parts of a circular cylinder are cut out along cutting planes parallel with the axis line of the support shaft 51 and thereby the thickness thereof in the direction orthogonal to the cutting planes is smaller than the diameter of the circular cylinder (i.e., a columnar shape in which the cross section shown in each of FIGS. 7A to 7E continues in the axis direction). The contacting member 47 is provided with a bearing 52 having the shape in which a ring-opening is formed in a part of a ring-shaped body (i.e., a shape formed in a letter "C" shown in FIGS. 7A to 7E).

As shown in FIG. 7C, the support shaft 51 and the bearing 52 are provided such that, when the rotation angle of the bearing 52 with respect to the support shaft 51 is set to a predetermined angle (within a first range), the support shaft 51 becomes able to pass through the ring-opening, and thereby the bearing 52 becomes attachable and detachable with respect to the support shaft 51. On the other hand, when the rotation angle of the bearing 52 with respect to the support shaft 51 is set to an angle (within a second range) other than the predetermined angle (see FIGS. 7D and 7E), the support shaft 51 becomes unable to pass through the ring-opening and thereby the bearing 52 moves to a state of not coming off the support shaft 51.

As shown in FIGS. 7A to 7E, the contacting member 47 is provided with a stopper 53, and the holder 54 is provided with a receiving part 54. By rotating the contacting member 47 in the direction indicated by an arrow in FIG. 7D after the support shaft 51 is attached to the bearing 52, the receiving part 54 elastically deforms and moves to a retracted position shown in FIG. 7D so as to allow the stopper 53 to swing and go over the receiving part 54. More specifically, the receiving part 54 is formed in a shape of a leaf spring extending leftward from the right end being a proximal end thereof. When the contacting member 47 is rotated in the direction indicated by the arrow in FIG. 7D, the stopper 53 presses the left end of the receiving part 54 at a first contacting surface 53A. The first contacting surface 53A is formed to have inclination by which the left end of the receiving part 54 is pushed downward when the first contacting surface 53A contacts the receiving part 54. Therefore, by pressing the receiving part 54 with the first contacting surface 53A, deformation of the receiving part 54 is induced, and thereby the stopper 53 swings easily to the position going over the receiving part 54.

On the other hand, after the contacting member 47 is moved to the above described position, the spring member 48 is disposed between the holder 41 and the contacting member 47. At this time, the spring member 48 presses the contacting member 47 in the direction indicated by an arrow in FIG. 7E, and the stopper 53 contacts the receiving part 54. However, in this case the receiving part 54 hardly deforms and thereby the receiving part 54 prevents the stopper 53 from swinging to the position going over the receiving part 54. More specifically, when the contacting member 47 is rotated in the direction indicated by the arrow in FIG. 7E, a second contacting surface 53B of the stopper 53 contacts and presses the left end of the receiving part 54 from the left side. The second contacting surface 53B has inclination to press the left end of the receiving part 54 rightward when the second contacting part 53B contacts the receiving part 54. Therefore, even when the second contacting part 53B presses the receiving part 54, the receiving part 54 hardly deforms in the up and down direction, and the stopper 53 does not move to the position going over the receiving part 54. Accordingly, the contacting member 47 does not swing to the position where the rotation angle of the bearing 52 with respect to the support shaft 51 becomes the state when in FIG. 7C, and there is no possibility that the contacting member 47 moves to the position where the contacting member 47 comes off the support shaft 51 due to the pressing force of the spring member 48.

The guide part 43 is a member configured to guide the document to the lower side of the holder 41 and the feed roller 11 when the document is set on the first support unit 21. As shown in FIG. 8A, on the lower surface of the guide part 43, a guide surface 44 is formed to extend to the upstream in the conveying direction with respect to the upstream end portion of the holder 41. When the document is set on the first support unit 21, the document contacts and slides on the guide surface 44, and is guided to the lower side of the holder 41 and the feed roller 11 along the guide surface 44.

As shown in FIG. 5B, the guide part 43 includes both side parts 43A and 43B disposed on the both sides in the axis direction of the holder 41 while sandwiching the holder 41 therebetween, and a connecting part 43C which connects the both side parts 43A and 43B on the upstream of the holder 41 in the conveying direction. The guide part 43 is formed as a single piece component (an integrally-molded component) integrally formed with the both side parts 43A and 43B and the connecting part 43C.

The guide part 43 is swingably attached to the holder 41 and swings about the axis line R1 shown in FIG. 5B. As shown in FIGS. 8A to 8D, a swing shaft 61 which rotatably supports the guide part 43 is integrally formed with the holder 41. The swing shaft 61 has a shape where parts of a circular cylinder are cut out along cutting planes parallel with the axis line of the swing shaft 61 and thereby the thickness thereof in the direction orthogonal to the cutting planes is smaller than the diameter of the circular cylinder (i.e., a columnar shape in which the cross section shown in each of FIGS. 8A to 8D continues in the axis direction). The guide part 43 is provided with a bearing 62 having the shape in which a ring-opening is formed in a part of a ring-shaped body (i.e., a shape formed in a letter "C" shown in FIGS. 8A to 8D).

Figure 8B:
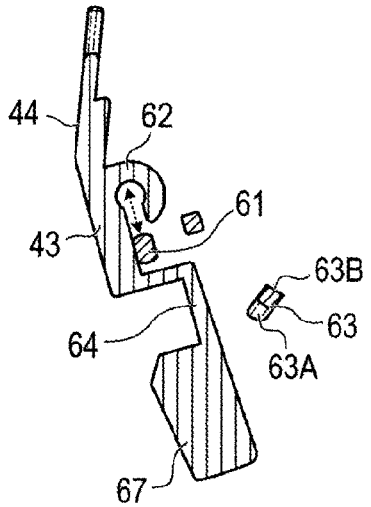
Figure 8C:
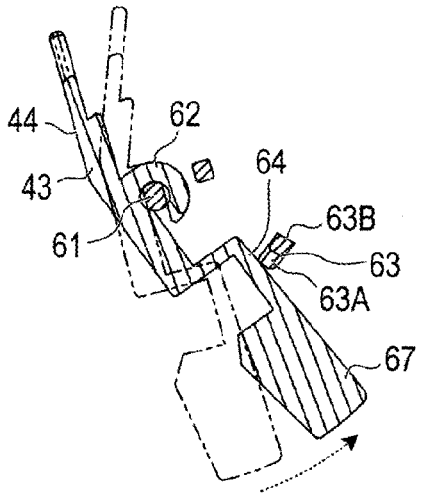

As shown in FIG. 8B, the swing shaft 61 and the bearing 62 are provided such that, when the rotation angle of the bearing 62 with respect to the swing shaft 61 is set to a predetermined angle (within a first range), the swing shaft 61 becomes able to pass through the ring-opening, and thereby the bearing 62 becomes attachable and detachable with respect to the swing shaft 61. On the other hand, when the rotation angle of the bearing 62 with respect to the swing shaft 61 is set to an angle (within a second range) other than the predetermined angle (see FIGS. 8C and 8D), the swing shaft 61 becomes unable to pass through the ring-opening and thereby the bearing 62 moves to a state of not coming off the swing shaft 61.

As shown in FIGS. 8A to 8D, the guide part 43 is provided with a receiving part 64, and the holder 41 is provided with a stopper 63. When the guide part 43 is rotated in a direction shown by an arrow in FIG. 8C after the bearing 62 is attached to the swing shaft 61, the receiving part 64 slightly displaces to the forehand side with respect to the paper face of FIG. 8C by elastically deforming, and the receiving part 64 is allowed to swing to a position going over the stopper 63. More specifically, when the guide part 43 is rotated in the direction shown by the arrow in FIG. 8C, the receiving part 64 contacts a first contact surface 63A of the stopper 63. The first contact surface 63A is provided with moderate inclination with respect to the moving direction of the receiving part 64. Therefore, when the receiving part 64 contacts the first contact surface 63A, the receiving part 64 elastically deforms gradually while sliding on the first contact surface 63A, and moves to the position going over the stopper 63.

Figure 8D:
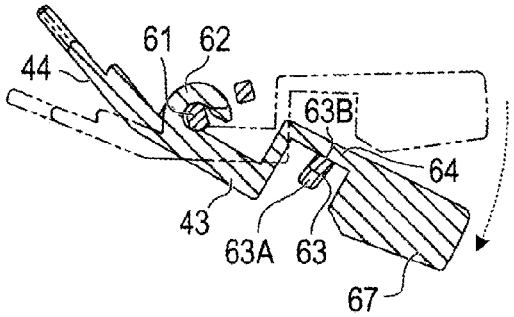

When the guide part 43 is displaced in a direction shown by an arrow in FIG. 8D after the guide part 43 has been displaced to the above described position, the receiving part 64 contacts the stopper 63. However, in this state, the receiving part 64 hardly deforms and thereby the stopper 63 prevents the receiving part 64 from being displaced to the position going over the stopper 63.

More specifically, when the guide part 43 is displaced in the direction indicated by the arrow in FIG. 8D, the receiving part 64 contacts a second contact surface 63B of the stopper 63. The second contact surface 63B is formed to be perpendicular to (or as a steep inclination with respect to) the moving direction of the receiving part 64. Therefore, even when the receiving part 64 contacts the second contact surface 63B, the receiving part 64 is not displaced along the second contact surface 63B, and therefore does not swing to the position going over the stopper 63. Accordingly, the guide part 43 does not swing to the position at which the rotation angle of the bearing 62 with respect to the swing shaft 61 is in the state of FIG. 8B (i.e., within the first range). As a result, there is no possibility that the guide part 43 is displaced to the position at which the guide part 43 is allowed to come off the swing shaft 61.

The guide part 43 is provided with a weight part 67 having adequate weight at a position on the downstream end portion of the guide part 43 with respect to the swing center thereof. With this configuration, the guide part 43 is formed to have the center of gravity at a position on the downstream end portion of the guide part 43 with respect to the swing center. Therefore, the guide part 43 swings by its own weight in the direction where the upstream end portion of the guide part 43 moves away from the first support unit 21.

As shown in FIG. 8A, when the second cover 17 is at the closed position, the cover 17 is disposed on the upper side of the holder 41. On the lower surface of the second cover 17 in the state shown in FIG. 8A, a first rib 71 protruding toward the guide part 43 is provided. More specifically, on the lower surface of the second cover 17, a plurality of first ribs 71 are formed in parallel to protrude toward the guide part 43 such that the plurality of first ribs 71 have intervals therebetween in the front and rear direction. In FIG. 8A, only one of the plurality of ribs 71 appears.

On the other hand, as shown in FIG. 5B, a plurality of first notches 72 are formed at the upstream end portion of the guide part 43 in the conveying direction. The number of the first notches 72 is the same as that of the first ribs 71. By letting the first ribs 71 enter the respective first notches 72, the upstream end portion of the guide part 43 in the conveying direction and the first ribs 71 are disposed to overlap with each other as shown in FIG. 8A. Therefore, when the user sets the document on the first support unit 21 and lets the leading edge of the document contact and slide on the lower ends of the plurality of ribs 71, the document is guided to the lower side of the guide part 43 along the first ribs 71, and then contacts and slides on the guide surface 44. As a result, the document is prevented from entering into the upper side of the guide part 43.

As shown in FIGS. 5A and 5B, the holder 41 has a plurality of second ribs 73 formed to protrude toward the upstream in the conveying direction. In the guide part 43, a plurality of second notches 74 to which the respective second ribs 73 enter are formed. When the document contacts and slides on the guide surface 44 of the guide part 43, the document is guided, along the guide surface 44, to the downstream in the conveying direction with respect to the upstream ends of the second ribs 73 in the conveying direction, and then is guided to the lower side of the holder 41. As a result, the document is prevented from entering into the gap between the guide part 43 and the holder 41.

Advantageous Effects

In the above described multifunction peripheral 1, when the user sets the document on the first support unit 21 and the leading edge of the document contacts the guide part 43, the holder 41 and the guide part 43 move in the direction of moving away from the first support unit 21. More specifically, in an initial state, the holder 41 and the guide part 43 have moved to the lowermost position shown in FIG. 7A by a pressing force from its own weight and the pressing parts 45.

On the other hand, when the leading edge of the document is pressed against the guide surface 44 of the guide part 43 and thereby a force to move the guide part 43 away from the first support unit 21 acts on the guide part 43, the force is transmitted to the holder 41 via the swing shaft 61 of the guide part 43. As a result, the holder 41 and the guide part 43 swing (in the counterclockwise direction in FIG. 7A) upward against the pressing force from its own weight and the pressing parts 45, and at most are displaced to the uppermost position shown in FIG. 7B.

At this time, the guide part 43 swings in the direction in which the upstream end portion of the guide part 43 in the conveying direction moves downward (in the clockwise direction in FIG. 7A) relative to the holder 41 in accordance with contacting with the document and other parts. Therefore, as can be clearly seen from the comparison between FIGS. 8A and 8B, regarding the moving amount in the direction of moving away from the first support unit 21, the moving amount of the upstream end portion of the guide part 43 is smaller than the moving amount of the upstream end portion of the holder 41.

Therefore, in contrast to a configuration in which an upstream end portion of a component corresponding to the holder 41 in the conveying direction is formed to simply extend in a range corresponding to the guide part 43, it is possible to prevent the upstream end portion of the guide part 43 in the conveying direction from excessively moving away from the first support unit 21 in accordance with the movement of the holder 41. As a result, it becomes possible to downsize the ADF unit 5 in the moving direction of the guide part 43 accordingly, and to make to the size of the ADF unit 5 compact in the height direction.

Furthermore, in contrast to a configuration in which the guide part 43 is not provided (i.e., in comparison with the case where the document is guide only by a component corresponding to the holder 41), the document may be guided from a more upstream position in the conveying direction when the user sets the document on the first support unit 21. As a result, the document may be guided more smoothly to the lower side of the feed roller 11.

In the above described multifunction peripheral 1, the holder 41 and the guide part 43 may be attached to a predetermined position together after attaching the guide part 43 to the holder 41. Therefore, in comparison with a configuration in which the holder 41 and the guide part 43 are separately attached to a target position, the attaching work may be eased.

In the above described multifunction peripheral 1, when a force for displacing the guide part 43 to move away from the first support unit 21 acts on the guide part 43 from the document contacting and sliding on the guide surface 44 of the guide part 43, the force is transmitted to the holder 41 via the swing shaft of the guide part 43. Therefore, it is possible to guide the document to the lower side of the holder 41 or the feed roller 11 while letting the guide part 43 and the holder 41 smoothly move together.

In the above described multifunction peripheral 1, when the guide part 43 swings in the direction in which the upstream end portion of the guide part 43 in the conveying direction moves away from the first support unit 21 and then the guide part 43 reaches the predetermined position, the stopper 63 contacts the receiving part 64 and the guide part 43 becomes unable to move further. Therefore, in contrast to a configuration where the guide part 43 is allowed to move further from this state, it becomes possible to prevent occurrence of such a trouble that the guide part 43 excessively swings and thereby interferes with other components.

In the above described multifunction peripheral 1, by setting the rotation angle of the bearing 62 with respect to the swing shaft 61 to be within the first range, the bearing 62 may be attached to the swing shaft 61. By thereafter setting the rotation angle of the bearing 62 with respect to the swing shaft 61 to be within the second range, the bearing 62 moves to the state of not coming off the swing shaft 61. In addition, in this state, the stopper 63 prevents the guide part 43 from swinging to a position at which the rotation angle of the bearing 62 is within the first range. Therefore, it is possible to keep, by the stopper 63, the bearing 62 in the state of not coming off the swing shaft 61. Accordingly, in comparison with the case where the above described configuration is not provided, the guide part 43 may be easily attached to the holder 41, and thereby it becomes possible to prevent the attached guide part 43 from coming off the holder 41.

In the above described multifunction peripheral 1, when the rotation angle of the bearing 62 with respect to the swing shaft 61 is changed from an angle within the first range to an angle with in the second range, the receiving part 64 goes over the stopper 63 while elastically deforming due to contacting with the first contact surface 63A. Therefore, in this case the stopper 63 does not become an obstacle. On the other hand, when the rotation angle of the bearing 62 with respect to the swing shaft 61 is changed from an angle within the second range to an angle within the first range, the receiving part 64 does not go over the stopper 63, and therefore the function of the stopper 64 and the receiving part 64 are demonstrated appropriately. Accordingly, in comparison with the case where the receiving part 64 does not elastically deform or the case where the receiving part 64 does not go over the stopper 63, the attaching work for the guide part 43 may be eased.

In the above described multifunction peripheral 1, when the document is set on the first support unit 21, the document is guided by the first rib 71 to the downstream in the conveying direction with respect to the upstream end portion of the guide part 43 in the conveying direction. Therefore, it becomes possible to prevent the document from being hooked to the upstream end portion of the guide part 43 in the conveying direction, and thereby it becomes possible to let the document smoothly contact the guide surface 44.

In the above described multifunction peripheral 1, the guide part 43 swings by its own weight in the direction in which the upstream end portion thereof in the conveying direction moves away from the first support unit 21. Therefore, it is possible to easily displace the guide part 43 such that the upstream end portion thereof in the conveying direction moves away from the first support unit 21 without providing a structure for applying an external force to the guide part 43, and to maintain this state. Accordingly, it is possible to displace the guide part 43 to an appropriate position in advance when the document is set.

In the above described multifunction peripheral 1, the guide part 43 is formed as a single piece member in which the both side parts 43A and 43B and the connecting part 43C are integrally provided. Therefore, in comparison with the case where the guide part 43 is formed with a plurality of components which are separately provided on the both sides of the holder 41, the guide part 43 may be easily attached. Therefore, a configuration for concurrently move such a plurality of components become unnecessary. Consequently, the configuration of the guide part 43 may be simplified.

In the above described multifunction peripheral 1, when the document is set on the first support unit 21, the document is guided by the guide surface 44 to the downstream in the conveying direction with respect to the upstream end of the second rib 73 in the conveying direction. Therefore, it is possible to prevent the document from being hooked to the upstream end of the second rib 73 in the conveying direction, and thereby it becomes possible to smoothly guide the document to the lower side of the holder 41.

In the above described multifunction peripheral 1, when the user sets the document on the first support unit 21, the leading edge of the document in the conveying direction is pressed against the guide part 43, and the document is guided to the space between the feed roller 11 and the first support unit 21 along the guide part 43. At this time, the feed roller 11 swings and thereby is displaced to the position corresponding to the thicknesses and the number of documents. The pressing parts 45 and 45 apply the pressing force to the holder 41 to press the feed roller 11 toward the first support unit 11. Therefore, it becomes possible to rotate the feed roller 11 to convey the document to the downstream in the conveying direction while appropriately pressing the document with the feed roller 11. Accordingly, in comparison with a conventional device where a document is conveyed by the weight of the feed roller 11 and adjustment of the rotation number of a motor, it is possible to convey the document to the downstream in the conveying direction without the need of complicated control.

Furthermore, in the above described multifunction peripheral 1, the pressing parts 45 and 45 and the feed roller 11 are disposed such that the pressing rollers 45 and 45 and the feed roller 11 do not overlap with each other in regard to the axis direction of the feed roller 11. Therefore, in comparison with a case where a structural component corresponding to the pressing part 45 is disposed to overlap with the feed roller 11 on the upper side, it is possible to decrease the size in the height direction of the structure including the feed roller 11 and the pressing parts 45 and 45 and thereby it becomes possible to decrease the thickness of the ADF unit 5.

In the above described multifunction peripheral 1, the contacting member 47 and the spring member 48 constituting the pressing parts 45 and 45 are provided on the holder 41 having the first portion 50A, and the contacting member 47 is caused to contact the second portion 50B provided on the second cover 17 by the pressing force of the spring member 48. Therefore, it is possible to configure the pressing parts 45 and 45 having the desired function without the need for providing components constituting the pressing parts 45 and 45 on the second cover 17 (the second portion 50B).

Since, in the above described multifunction peripheral 1, the pressing parts 45 and 45 are provided on the both sides in the axis direction of the feed roller 11 while sandwiching the feed roller 11 therebetween, it is possible to apply a well-balanced load on the feed roller 11. Since, in the above described multifunction peripheral 1, the feed roller 11 and the spring member 48 are disposed to overlap with each other when viewed along the rotation axis direction of the feed roller 11, the structure including the feed roller 11 and the spring member 48 may be made compact in size in comparison with a case where the feed roller 11 and the spring member 48 are disposed not to overlap with each other when viewed along the rotation axis direction of the feed roller 11.

In the above described multifunction peripheral 1, the contacting member 47 contacts the second portion 50B at the corner part 47. Therefore, in contrast to the case where the contacting part 47 is in surface contact with the second portion 50B, the corner part 47A may be securely caused to contact the second portion 50B even when the contacting part 47 swings, and thereby it becomes possible to prevent the contacting position on the contacting member 47 from becoming unstable.

Since, in the above described multifunction peripheral 1, the contacting member 47 is rotatably supported by the support shaft 51 integrally formed with the holder 41, there is no necessity to prepare a separate support shaft which is a component separately provided from the holder 41 and therefore the configuration of the pressing parts 45 and 45 may be simplified.

Furthermore, in the above described multifunction peripheral 1, the spring member 48 is provided to intervene between the contacting member 47 and the holder 41 at the position separated from the swing center of the holder 41. Therefore, in comparison with the case where the spring member 48 applies the pressing force to a position close to the swing center of the holder 41, it is possible to cause the pressing force to effectively act on the holder 41 from the pressing parts 45 and 45.

Since the above described multifunction peripheral 1 includes the stopper 53 and the receiving part 54, when the contacting member 47 reaches the predetermined position by the pressing force from the spring member 48, the contacting member 47 becomes unable to swing further. Therefore, in contrast to the configuration where the contacting member 47 swings further from this state, it is possible to easily maintain the state where the spring member 48 is sandwiched between the contacting member 47 and the holder 41, and thereby it becomes possible to prevent the spring member 48 from falling off.

In the above described multifunction peripheral 1, when the rotation angle of the bearing 52 with respect to the support shaft 51 is set within the first range, the bearing 52 may be attached to the support shaft 51. By subsequently setting the rotation angle of the bearing 52 with respect to the support haft 51 within the second range, the bearing 52 moves to the state of not coming off the support shaft 51. In addition, since in this state the stopper 53 prevents the contacting member 47 from swinging to the position where the rotation angle of the bearing 52 is within the first range, the state where the bearing 52 does not come off the support shaft 51 may be maintained by the stopper 53. Therefore, in comparison with the case where such a configuration is not provided, the contacting member 47 may be easily attached to the holder 41, and thereby it becomes possible to prevent the attached contacting member 47 from coming off the holder 41.

In the above described multifunction peripheral 1, when the rotation angle of the bearing 52 with respect to the support shaft 51 is changed from an angle within the first range to an angle within the second range, the receiving part 54 is retracted to the retracted position by a force received from the stopper 53 and therefore the receiving part 54 does not become an obstacle. On the other hand, when trying to change the rotation angle of the bearing 52 with respect to the support shaft 51 from an angle within the second range to an angle within the first range, the receiving part 54 is not moved to the retracted position by the force received from the stopper 53. Therefore, in this case, the function as the receiving part 54 is appropriately demonstrated. Therefore, in comparison with the configuration where the receiving part 54 is not retracted or the receiving part 54 needs to be operated to retract before moving the stopper 53, the work for attaching the contacting part 47 may be eased.

Other Embodiments

The concrete embodiment of the sheet conveyer and the image reading apparatus have been explained above by giving the example of the multifunction peripheral 1; however, the invention is not limited to the above described embodiment, but can be varied within the scope of the invention.

For example, in the above described embodiment, the guide part 43 is swingably attached to the holder 41; however, a component corresponding to the guide part 43 may be attached to a member disposed on the upper side of a component corresponding to the holder 41. As an example, as shown in FIGS. 9A and 9B, a guide part 81 may be attached, to be swingable about a swing shaft 81A, to a second cover 83 disposed on the upper side of the holder 41. The second cover 83 is a member equivalent to the above described second cover 17 in regard to the function thereof. When a force for displacing the guide part 81 to move away from the first support unit 21 acts on the guide part 81 from the document contacting and sliding on a guide surface 82, the guide part 81 transmits the force to the holder 41 via a contacting part 85 where the guide part 81 and the holder 41 contact with each other. As a result, the holder 41 is caused to swing.

The guide part 81 configured as described above is able to guide the document from the more upstream in the conveying direction without causing the upstream end portion of the holder 41 in the conveying direction to be excessively displaced upward. Therefore, in this point of view, the guide part 81 is also able to achieve substantially the same advantageous effects as those achieved by the above described guide part 43. In addition, in the case of the guide part 81, the guide part 81 is not configured to swing with respect to the holder 41. Therefore, the position and the moving range of the guide part 81 may be set without considering the position and movement of the holder 41, and thereby it becomes possible to dispose the guide surface 82 at a position suitable for guiding the document.

In the case of the guide part 81, when a force for displacing the guide part 81 to move away from the first support unit 21 acts on the guide part 81 from the document contacting and sliding on the guide surface 82 of the guide part 81, the force is transmitted to the holder 41 via the contacting point where the guide part 81 contacts the holder 41. As a result, the holder 41 swings and thereby the upstream end portion of the holder 41 in the conveying direction moves in the direction of moving away from the first support unit 21. Accordingly, it is possible to guide the document to the lower side of the holder 41 or the feed roller 11 while letting the guide part 81 and the holder 41 smoothly move together.

In the above described embodiment, the example where the pressing part 45 is formed of the contacting member 47 and the pressing member 48 is given; however, the pressing part may be formed only of the spring member 48 by omitting the contacting member 47. Alternatively, in the case where the contacting member 47 is provided, whether to provide the contacting member 47 to be swingable is optional, and therefore the contacting part 47 may be provided to be slidable in the up and down direction.

In the above described embodiment, the pressing part 45 is provided on the holder 41, and is configured to contact the second cover 17; however, a component corresponding to the pressing part 45 may be provided on a component corresponding to the second cover 17 and may contact a component corresponding to the holder 41.

In the above described embodiment, the pressing part 45 contacts the second cover 17; however, when a member having the function different from that of the second cover 17 is provided on the upper side of the pressing part 45, the pressing part 45 may contact the member. That is, whether or not a target component which the pressing part 45 contacts is a member having the function as a cover is optional.

In the above described embodiment, the reading unit 3 corresponding to the image reading apparatus and the ADF unit 5 corresponding to the sheet conveyer 5 are provided in the multifunction peripheral 1; however, the configuration of the embodiment may be used in a single-function image scanner.

What is claimed is:

1. A sheet conveyer, comprising:

a sheet support surface configured to support sheets;

a first roller configured to convey the sheets supported by the sheet support surface to a downstream position in a conveying direction;

a second roller configured to separate one by one the sheets conveyed by the first roller and to convey a sheet to the downstream position in the conveying direction;

a holder configured to be swingably supported about a swing center axis coinciding with a rotation center of the second roller, wherein the first roller is attached to the holder to be rotatable about an axis parallel with the swing center axis; and a guide formed of a member, the guide comprising a guide surface extending on an upstream position in the conveying direction with respect to an upstream end portion of the holder in the conveying direction, the guide being configured such that when the sheet is set on the sheet support surface and the sheet contacts and slides on the guide surface, the guide guides the sheet to a portion below the holder and the first roller along the guide surface, wherein the guide is swingably attached to the holder, and wherein when a force for displacing the guide to move away from the sheet support surface acts on the guide surface from the sheet contacting and sliding on the guide surface, the guide transmits the force to the holder via a swing shaft of the guide to cause the holder to swing.

2. The sheet conveyer according to claim 1, wherein:

the holder comprises a stopper;

the guide comprises a receiving part; and when the upstream end portion of the guide in the conveying direction reaches a predetermined position while swinging in the direction moving away from the sheet support surface, the stopper contacts the receiving part and prevents the guide from swinging to a position going over the predetermined position.

3. The sheet conveyer according to claim 2, wherein:

the holder is integrally formed with the swing shaft;

the swing shaft has a shape where parts of a circular cylinder are cut out along cutting planes parallel with an axis line of the swing shaft and thereby a thickness of the swing shaft in a direction orthogonal to the cutting planes is smaller than a diameter of the circular cylinder;

the guide comprises a bearing having a shape in which a ring-opening is formed in a part of a ring-shaped body;

when a rotation angle of the bearing with respect to the swing shaft is set to an angle within a first range, the swing shaft becomes able to pass through the ring-opening and thereby the bearing becomes attachable to and detachable from the swing shaft;

when the rotation angle of the bearing with respect to the swing shaft is set to an angle within a second range, the swing shaft becomes unable to pass through the ring-opening and the bearing becomes unable to come off the swing shaft; and by contacting the receiving part, the stopper prevents the guide from swinging to a position where the rotation angle of the bearing with respect to the swing shaft is within the first range.

4. The sheet conveyer according to claim 3, wherein:

the stopper comprises a first contact surface which contacts the receiving part when the rotation angle of the bearing with respect to the swing shaft is changed from an angle within the first range to an angle within the second range, and a second contact surface which contacts the receiving part when the rotation angle of the bearing with respect to the swing shaft is changed from an angle within the second range to an angle within the first range;

the first contact surface is provided with such an inclination that, in relation to a moving direction of the receiving part, the receiving part goes over the stopper by letting the receiving part contact and slide on the first contact surface while elastically deforming; and the second contact surface is provided with such an inclination that, in relation to the moving direction of the receiving part, the receiving part contacting the second contact surface is unable to go over the stopper.

5. The sheet conveyer according to claim 1, further comprising a member configured to comprise a first rib protruding toward the guide and is disposed above the holder, wherein:

the guide is formed with a first notch into which the first rib enters; and when the sheet contacts and slides on the first rib, the sheet is guided to the downstream position in the conveying direction with respect to the upstream end portion of the guide in the conveying direction, and then the sheet contacts and slides on the guide surface.

6. The sheet conveyer according to claim 1, wherein:

the guide has a center of gravity at a position on the downstream position in the conveying direction with respect to a swing center of the guide; and the upstream end portion of the guide swings by the weight of the guide in a direction moving away from the sheet support surface.

7. The sheet conveyer according to claim 1, wherein the guide comprises:

both side parts disposed on both sides in an axis direction of the holder while sandwiching the holder therebetween; and a connecting part configured to connect the both side parts on the upstream position of the holder in the conveying direction, wherein the guide is a single piece member formed integrally with the both side parts and the connecting part.

8. The sheet conveyer according to claim 1, wherein:

the holder comprises a second rib protruding to the upstream position in the conveying direction;

the guide is formed with a second notch into which the second rib enters; and when the sheet contacts and slides on the guide surface, the sheet is guided to the downstream position in the conveying direction with respect to the upstream end portion of the second rib in the conveying direction, and then the sheet is guided to the portion below the holder.

9. The sheet conveyer according to claim 1, wherein the holder is configured to be able to change an interval between the first roller and the sheet support surface by swinging together with the first roller.

10. A sheet conveyer comprising:

a sheet support surface configured to support sheets;

a first roller configured to convey the sheets supported by the sheet support surface to a downstream position in a conveying direction;

a second roller configured to separate one by one the sheets conveyed by the first roller and to convey a sheet to the downstream position in the conveying direction;

a holder configured to be swingably supported about a swing center axis coinciding with a rotation center of the second roller, wherein the first roller is attached to the holder to be rotatable about an axis parallel with the swing center axis; and a guide formed of a member, the guide comprising a guide surface extending on an upstream position in the conveying direction with respect to an upstream end portion of the holder in the conveying direction, the guide being configured such that when the sheet is set on the sheet support surface and the sheet contacts and slides on the guide surface, the guide guides the sheet to a portion below the holder and the first roller along the guide surface, wherein the guide is swingably attached to a member disposed above the holder, and wherein when a force for moving the guide to move away from the sheet support surface acts on the guide from the sheet contacting and sliding on the guide surface, the guide transmits the force to the holder via a contacting point between the guide and the holder.

11. An image reading apparatus, comprising:

a reading unit configured to read an image on a sheet conveyed along a predetermined sheet conveying path;

a sheet support surface configured to support sheets;

a first roller configured to convey the sheets supported by the sheet support surface to a downstream position in a conveying direction;

a second roller configured to separate one by one the sheets conveyed by the first roller and to convey a sheet to the downstream position in the conveying direction;

a holder configured to be swingably supported about a swing center axis coinciding with a rotation center of the second roller, wherein the first roller is attached to the holder to be rotatable about an axis parallel with the swing center axis; and a guide formed of a member, the guide comprising a guide surface extending on an upstream position in the conveying direction with respect to an upstream end portion of the holder in the conveying direction, the guide being configured such that when the sheet is set on the sheet support surface and the sheet contacts and slides on the guide surface, the guide guides the sheet to a portion below the holder and the first roller along the guide surface, wherein the guide is swingably attached to the holder, and wherein when a force for displacing the guide to move away from the sheet support surface acts on the guide surface from the sheet contacting and sliding on the guide surface, the guide transmits the force to the holder via a swing shaft of the guide to cause the holder to swing.

12. The image reading apparatus according to claim 11, wherein the holder and the guide are configured such that:

when the sheet is guided to the portion below the first roller, the holder and the guide move in a direction moving away from the sheet support surface;

when the holder and the guide move in the direction moving away from the sheet support surface, the guide moves relative to the holder; and in regard to moving amounts in the direction moving away from the sheet support surface, a moving amount of an upstream end portion of the guide in the conveying direction is smaller than a moving amount of the upstream end portion of the holder in the conveying direction.

* * * * *